United States Patent [19]

Bartley

[11] Patent Number: 4,586,663

[45] Date of Patent: May 6, 1986

[54] TIP ASSEMBLY FOR ROTARY MINERAL BREAKERS

[75] Inventor: Bryan A. Bartley, Auckland, New Zealand

[73] Assignee: Barmac Associates Limited, Wellington, New Zealand

[21] Appl. No.: 520,160

[22] Filed: Aug. 4, 1983

[30] Foreign Application Priority Data

Aug. 7, 1982 [NZ] New Zealand ..... 201190

[51] Int. Cl.[4] ..... B02L 13/28

[52] U.S. Cl. ..... 241/197; 241/275; 241/292.1; 241/300

[58] Field of Search ..... 241/197, 188 R, 275, 241/292.1, 294, 300

[56] References Cited

U.S. PATENT DOCUMENTS 3,838,826 10/1974 Wallace et al. ..... 241/197

4,307,845 12/1981 Larimer et al. ..... 241/197 X

*Primary Examiner*—Howard N. Goldberg

*Assistant Examiner*—Timothy V. Eley

*Attorney, Agent, or Firm*—Ladas & Parry

[57] ABSTRACT

A rotary mineral breaker has wear tip over which the mineral pieces are passed when discharged from the rotor. A supplementary wear tip is provided as a back up for the main wear tip so that failure of the main wear tip will not result in undue damage occurring to the rotor. Also the main wear tip is provided as two interchangeable pieces to improve the useful life of the wear tip.

3 Claims, 7 Drawing Figures

TIP ASSEMBLY FOR ROTARY MINERAL BREAKERS

This invention relates to rotary mineral breakers.

BACKGROUND TO INVENTION

Our unique rotary mineral breaker is described and claimed in our U.S. patent specification No. 3,970,257. While this apparatus is extremely satisfactory in use a problem can arise where one of the hardened wear tips overwhich the minerals pass fails and the apparatus is still maintained in use. In such circumstances a section of the rotor can be worn away comparatively quickly leading to a significant maintenance operation.

THE PRESENT INVENTION

The present invention provides a back up wear tip designed to operate if the main wear tip fails so that operation of the rotor where the main wear tip has failed will not cause undue damage to the rotor. This means that even with a tip failure the rotor could operate without harm between normal maintenance periods.

The tip mounting plate is formed in two sections so that the two pieces can be changed over if desired to give a longer life to the wear tips carried in the plates. To maintain alignment and prevent any gap forming in the hardened edge of the tip exposed in use two pieces are bonded together, for example, by a tack of arc welding.

DRAWING DESCRIPTION

Figure 1:
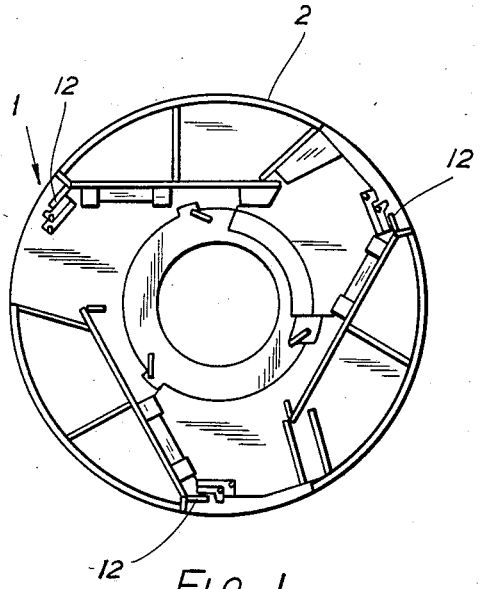
Figure 2:
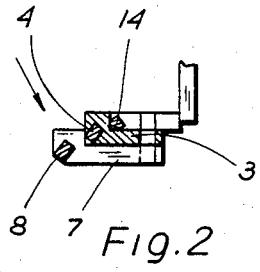
Figure 3:
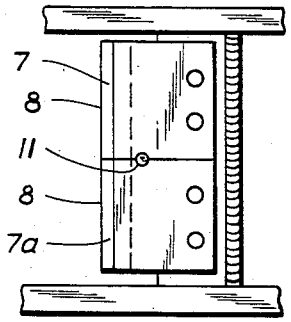
Figure 6:
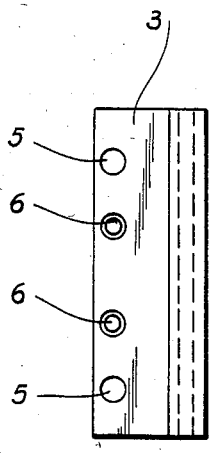
Figure 4:
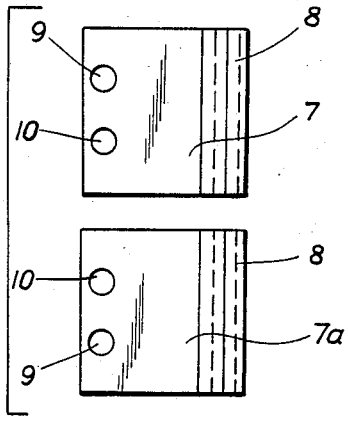
Figure 7:
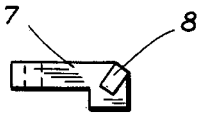
Figure 5:
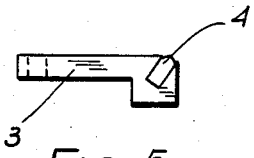

One preferred form of the invention will now be described with reference to the accompanying drawings in which FIG. 1 is a plan view of a rotor showing a tip assembly according to the present invention fitted in use, FIG. 2 is a sectional view through the tip assembly, FIG. 3 is a top view of the tip assembly, FIG. 4 is top view of the two sections of the mounting plate with the tip therein, FIG. 5 is an end view, FIG. 6 is a top view of the carrier blade, and FIG. 7 is an end view of the carrier blade.

PREFERRED EMBODIMENT

In the preferred form of the invention a tip assembly 1 according to the present invention is mounted on a rotor 2. The rotor illustrated is a three blade rotor.

Each tip assembly comprises a carrier blade 3 which has supported therein a hardened tip 4 at what would be the operative edge if the carrier blade was used and mineral material passed thereover. Four apertures are formed through the carrier blade 3. The two outer apertures 5 are designed in use to receive mounting bolts and the two inner apertures 6 are threaded apertures to receive studs. The tip 4 may be a tungsten carbide grade 438 tip.

The carrier blade 3 provides the support for the mounting plates 7 and 7*a*. Each mounting plate also has fitted therein a hardened tip 8 mounted within a recess at the operative (or outer) edge of the mounting plate. The outer apertures 9 in the plate 7 and 7*a* correspond with the apertures 5 in the carrier blade. The apertures 10 correspond with the threaded apertures 6. In use screws are passed through the apertures 10 to engage with the threaded apertures 6 to fix the mounting plate to the carrier blade and form the tip assembly.

This assembly is completed by applying a tack of weld 11 to ensure that the tips 8 are held tightly together and no gap will develop in use. This assembly is held onto the mounting position 12 on the rotor 2 by bolts passing through the aligned apertures 9 and 5 and corresponding apertures on the mounting position.

The mounting position 12 may also be formed with a hardened tip 14 incorporated therein. This means that if the tip assembly as above described is used there is a still further back up wear tip. It also allows a normal wear tip to be used while still protecting the rotor. Should a failure of the main wear tip occur it would probably be necessary to replace the mount 12 but this is still preferable to having substantial damage occur to the rotor. The present tip assembly has two significant advantages. First, in the event that the tip 8 fails in use and the tip plate is worn away, the tip 4 will then take over and continue to operate. Similar protection would apply where the mount 12 incorporates the wear tip 14. Such an operation will last during the normal non stop operating period of the machine and at the regular inspection and maintenance interval it will be readily apparent there has been a tip failure and the tip assembly can be changed. In this way a far more useful tip assembly is provided which will minimise the likelihood of damage to the rotor in the event of a tip assembly failing during an operating period.

The operating characteristic of the machine is such that the hardened tip will tend to wear in the centre before it wears towards the edges. Thus when this has occurred during a maintenance period the tip assembly may be removed. The removed worn tip assembly can have the mounting plates 7 and 7*a* changed over and in this way the section of the tip which is worn the least is placed in a position where the wear will be the maximum. The tip assembly is then put together in a manner similar to that previously described and is then ready for reinsertion in a rotor for a further period of operation. In this way a longer life can be obtained from the tip assembly. Because the main wear tip has the back up wear tip extended use of the main tip is possible because even if there is a failure of the tip during one operating period the rotor will not be damaged.

What is claimed is:

1. A tip assembly for the rotor of a centrifugal mineral breaker comprising, said rotor being rotated about a substantially vertical axis and having material infeed means oriented in the direction of the vertical axis, radial discharge ports being positioned remotely from the vertical axis, each said port having a trailing edge at which said tip assembly is mounted, said tip assembly further comprising;

a carrier blade extending across the width of the trailing edge of the port, said carrier blade being fitted in place to provide a mounting surface and to form an outer edge over which material from the port will pass in use, a recess extending in from said outer edge of said carrier blade, an insert of wear resistant material fixed in said recess, two replaceable mounting plates mounted on said carrier by mounting means to protect the outer edge of the carrier plate, said mounting plates in their mounted position forming an outer edge adopted to accommodate material passing over from the port, a recess extending in from an outer edge of each mounting plate, at least one insert of wear resistent material fixed in each said recess extending in from the outer edge of the mounting plate, said mounting means for the mounting plate allowing said mounting plates to be fitted in either position on said carrier plate so that after initial wear the position of the mounting plates may be changed to extended the useful life of said mounting plates.

2. A tip assembly as claimed in claim 1 wherein said replaceable mounting plates are bolted to the carrier blade and correctly positioned fixed together with a tack of weld.

3. A tip assembly as claimed in claim 1 wherein the carrier is mounted on the rotor.

* * * * *